US007332687B2

(12) United States Patent
Liu

(10) Patent No.: US 7,332,687 B2
(45) Date of Patent: Feb. 19, 2008

(54) KEYBOARD STRUCTURE AND KEYBOARD ASSEMBLY METHOD

(75) Inventor: Hung-Chieh Liu, Taipei County (TW)

(73) Assignee: Jensin Intl Technology Corp., Taipei County (TW)

( * ) Notice: Subject to any disclaimer, the term of this patent is extended or adjusted under 35 U.S.C. 154(b) by 0 days.

(21) Appl. No.: 11/538,441

(22) Filed: Oct. 4, 2006

(65) Prior Publication Data

US 2007/0102274 A1 May 10, 2007

(30) Foreign Application Priority Data

Nov. 4, 2005 (TW) ..... 94138722 A

(51) Int. Cl.
*H01H 13/70* (2006.01)

(52) U.S. Cl. ..... 200/344; 200/5 A

(58) Field of Classification Search ..... 200/344, 200/345

See application file for complete search history.

(56) References Cited

U.S. PATENT DOCUMENTS

| | | | | |
|---|---|---|---|---|
| 6,706,986 | B2 * | 3/2004 | Hsu | 200/344 |
| 6,713,700 | B2 * | 3/2004 | Hsu | 200/344 |
| 6,733,196 | B2 * | 5/2004 | Lee et al. | 400/480 |
| 6,797,906 | B2 * | 9/2004 | Ohashi | 200/517 |

* cited by examiner

*Primary Examiner*—Elvin Enad
*Assistant Examiner*—Lheiren Mae A. Anglo
(74) *Attorney, Agent, or Firm*—Jianq Chyun IP Office

(57) ABSTRACT

A keyboard structure including a base, a key-cap, and a linking-up mechanism is provided. The key-cap is disposed on the base, and the linking-up mechanism is connected between the base and the key-cap. The linking-up mechanism includes a first frame and a second frame. The first frame is connected to the key-cap. The first frame has two openings and two guide slots on two opposite sides, and the openings are connected to the guide slots correspondingly. The second frame is pivoted to the base, and the first frame is pivoted to the second frame crosswise. The second frame has two pivotal arms and two open slots on two opposite sides. Each pivotal arm has a fixing protrusion pivoted in the opening.

8 Claims, 5 Drawing Sheets

KEYBOARD STRUCTURE AND KEYBOARD ASSEMBLY METHOD

CROSS-REFERENCE TO RELATED APPLICATION

This application claims the priority benefit of Taiwan application serial no. 94138722, filed Nov. 4, 2005. All disclosure of the Taiwan application is incorporated herein by reference.

BACKGROUND OF THE INVENTION

1. Field of the Invention

The present invention relates to a keyboard structure and an assembly method thereof. More particularly, the present invention relates to a keyboard structure suitable for automatic assembly and an automatic assembly method thereof.

2. Description of Related Art

Electronic products have been applied broadly in our daily life along with the development of technology. Some commonly used electronic apparatuses include cell phone, electronic dictionary, personal digital assistant (PDA), personal computer (PC), and notebook computer (NB), etc.

Taking PC as an example, the usually a keyboard is used for inputting data into the PC and then the data conveniently stored into the PC. FIG. 1 is a schematic diagram of a conventional keyboard structure. Referring to FIG. 1, the conventional keyboard structure 100 is composed of a key-cap 110, a base 120, and a linking-up mechanism 130 connected between the key-cap 110 and the base 120. Wherein the linking-up mechanism 130 includes two frames 132 and 134 which are pivoted crosswise. To assemble the keyboard structure 100, first the frames 132 are 134 are pivoted crosswise manually to form the linking-up mechanism 130, and then the linking-up mechanism 130 is connected between the key-cap 110 and the base 120.

However, the labor cost of manual assembling operation cannot be reduced. Moreover, if the conventional keyboard structure 100 is assembled with an automatic machine, the fixing protrusion (not shown) on the frame 134 may be broken because the frames 132 and 134 in the keyboard structure cannot bear the instantaneous impulsive force of the automatic machine due to the high structural strength thereof, thus the reliability is reduced.

SUMMARY OF THE INVENTION

Accordingly, the present invention is directed to a keyboard structure suitable for automatic assembly to reduce the labor cost.

According to another aspect of the present invention, an automatic keyboard assembly method is provided to reduce the labor cost.

To achieve aforementioned and other objectives, the present invention provides a keyboard structure including a base, a key-cap, and a linking-up mechanism. Wherein the key-cap is disposed on the base, and the linking-up mechanism is connected between the base and the key-cap. The linking-up mechanism includes a first frame and a second frame, wherein the first frame is pivoted to the base and has two openings and two guide slots on the two opposite sides thereof, and the openings are connected to the guide slots correspondingly. In addition, the second frame is connected to the key-cap, and the first frame is pivoted crosswise to the second frame. The second frame has two second pivotal arms and two open slots on the two opposite sides thereof, wherein each of the second pivotal arms has a fixing protrusion pivoted in the opening.

According to an exemplary embodiment of the present invention, the key-cap may have two first slots and two first fixing bumps. Wherein the second frame has a first pivotal rod corresponding to the first slots, and the first frame has a first sliding rod corresponding to the first fixing bumps.

According to an exemplary embodiment of the present invention, the base may have two second slots and two second fixing bumps. Wherein the first frame has a second pivotal rod corresponding to the second slots, and the second frame has a second sliding rod corresponding to the second fixing bumps.

According to an exemplary embodiment of the present invention, the first frame may have two first pivotal arms, two openings penetrating through the first pivotal arms, and two guide slots located at the internal sides of the first pivotal arms and connecting the near ends of the openings. Wherein the guide slots may be a V-shaped slots.

According to an exemplary embodiment of the present invention, the fixing protrusions are protruded from the external sides of the second pivotal arms, and the open slots are located in the second pivotal arms and extended along the length of the second pivotal arms. Wherein the area on the second pivotal arms between the fixing protrusions and the open slots is an elastic deformation portion.

The present invention further provides a keyboard assembly method including following steps. First, a first frame and a second frame are provided. Wherein the first frame has two openings and two guide slots on the two opposite sides thereof, and the two openings and the two guide slots are connected correspondingly. The second frame has two pivotal arms and two open slots on the two opposite sides thereof, and each pivotal arm has a fixing protrusion. Next, the fixing protrusions of the second frame are moved along the corresponding guide slots and are placed into the openings so that the first frame is pivoted crosswise to the second frame to form a linking-up mechanism. After that, a base and a key-cap are provided, and the linking-up mechanism is connected between the base and the key-cap.

According to an exemplary embodiment of the present invention, the method of placing the fixing protrusions into the openings includes using a mechanical arm to hold the second frame and moving the fixing protrusions along the corresponding guide slots to place the fixing protrusions into the openings.

According to an exemplary embodiment of the present invention, the method for connecting the linking-up mechanism between the base and the key-cap may include connecting the first frame to the key-cap and pivoting the second frame to the base.

According to the present invention, the keyboard structure has guide slots and an elastic deformation portion so that when the keyboard structure is assembled with an automatic keyboard assembly method, the linking-up mechanism thereof won't be damaged. Thus, the reliability assembly rate is increased and the labor cost is reduced.

In order to make the aforementioned and other objects, features and advantages of the present invention comprehensible, a preferred embodiment accompanied with figures is described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
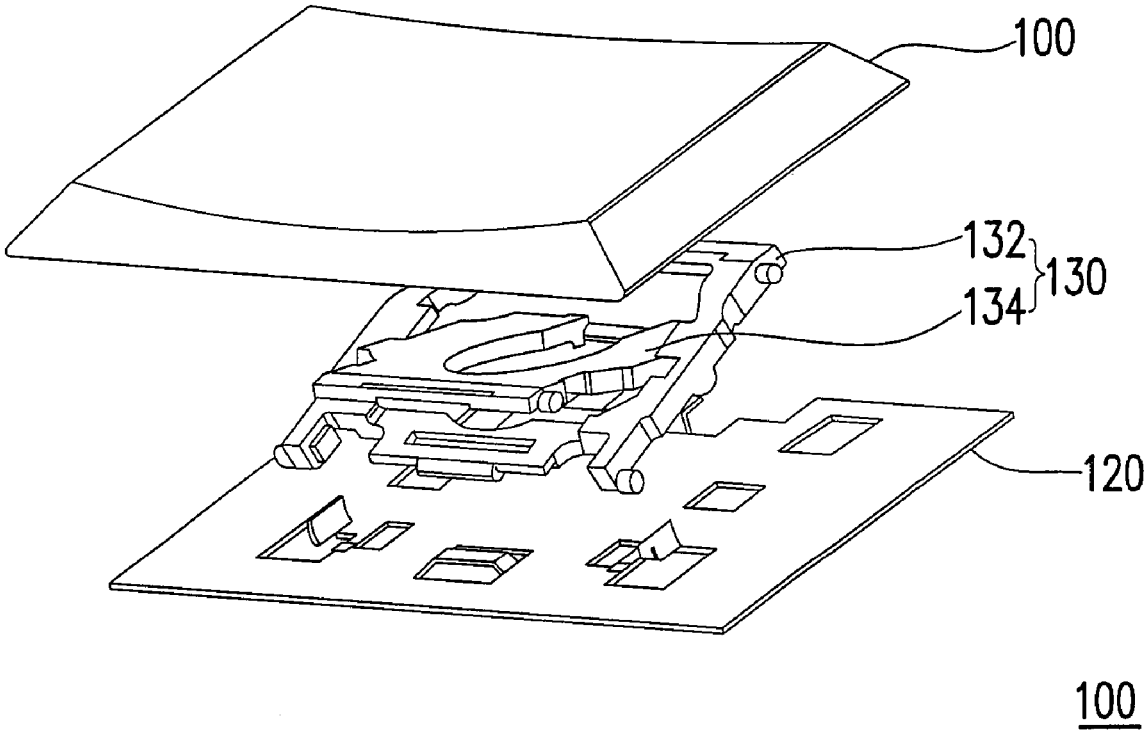
FIG. 1 (PRIOR ART)
FIG. 1 is a schematic diagram of a conventional keyboard structure.
Figure 2:
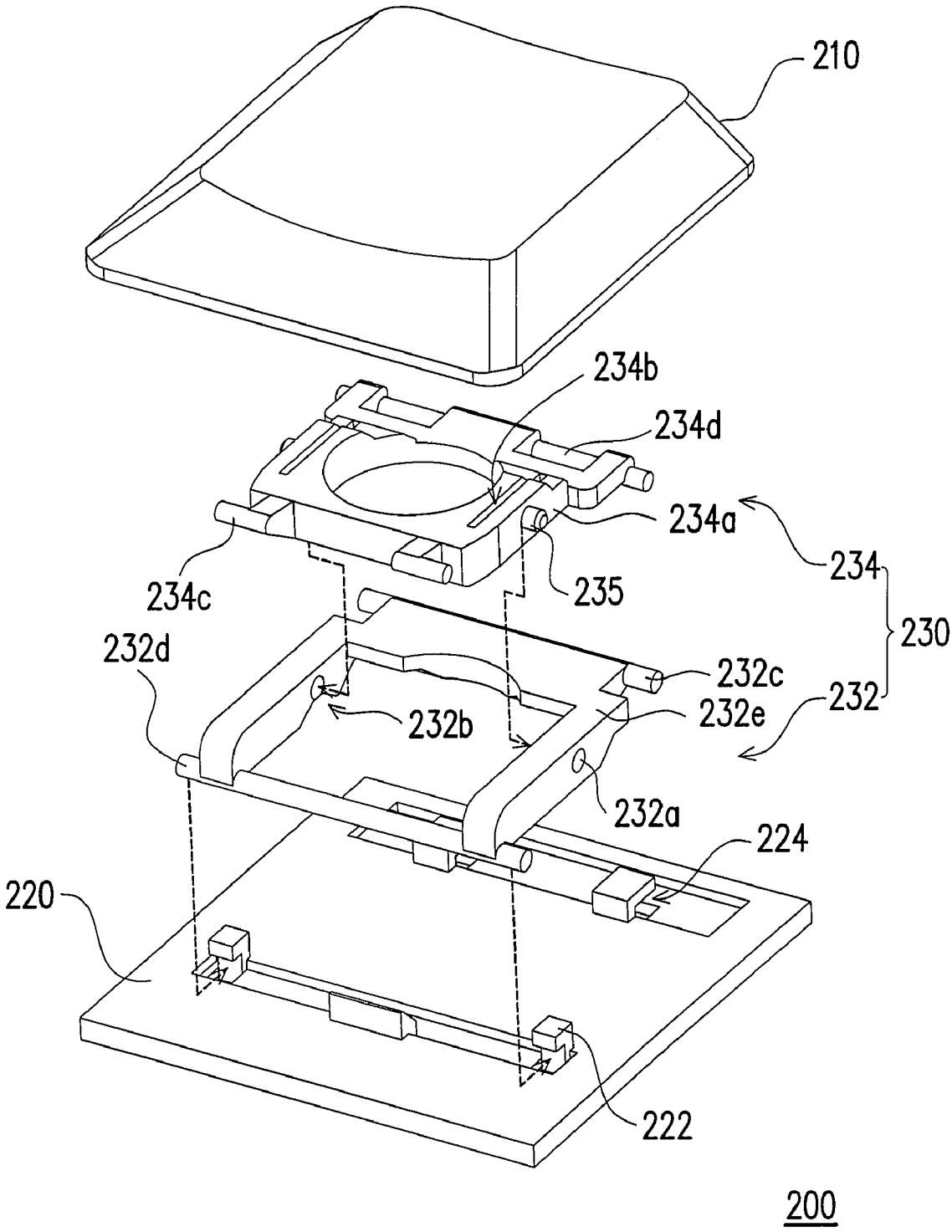
FIG. 2 is an exploded diagram of a keyboard structure according to an embodiment of the present invention.
Figure 3:
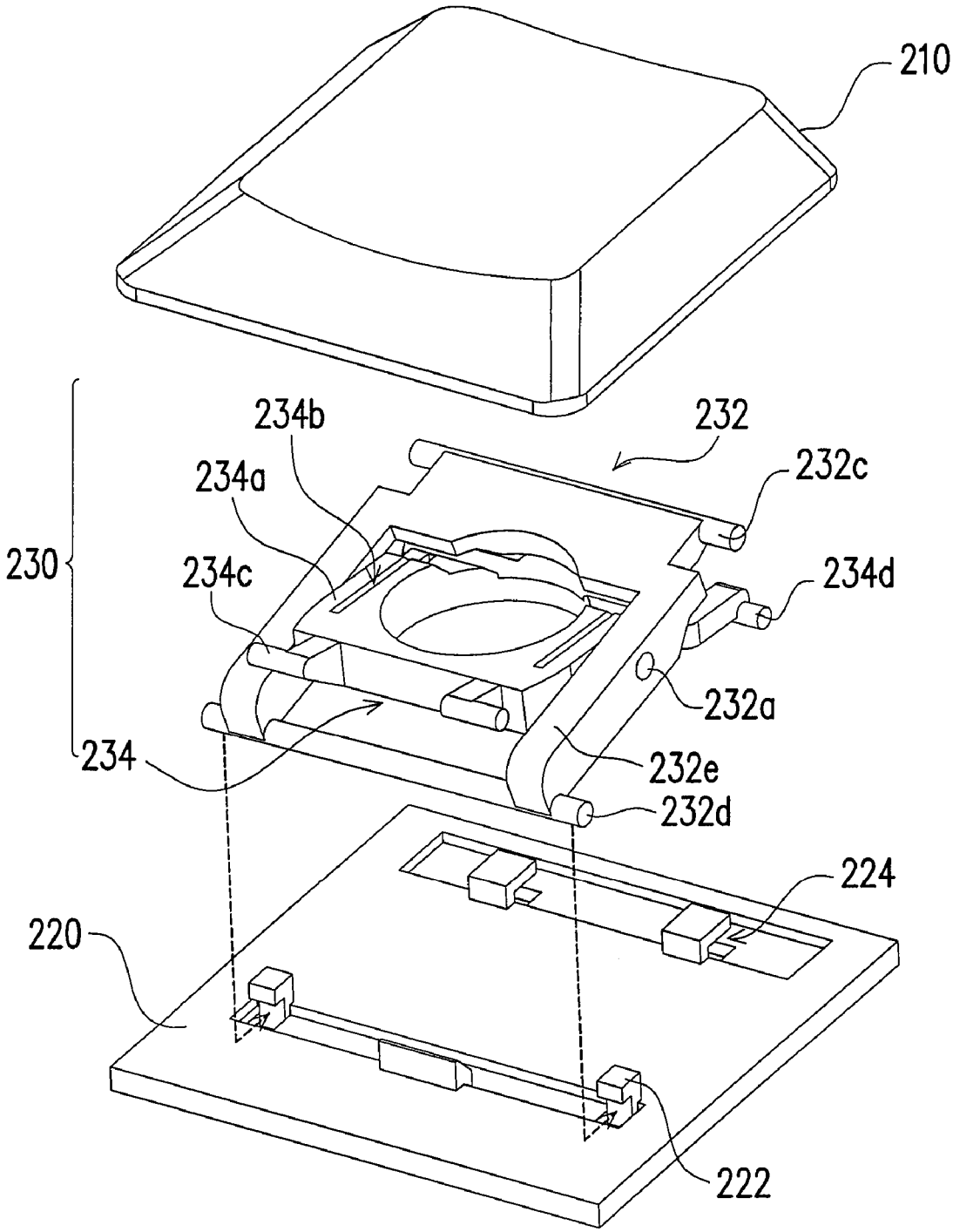
FIG. 3 is an exploded diagram of a first frame according to an embodiment of the present invention.

FIG. 2 is an exploded diagram of a keyboard structure according to an embodiment of the present invention. FIG. 3 is an exploded diagram illustrating the cross pivoting between the first frame and the second frame in FIG. 2. Referring to both FIG. 2 and FIG. 3, the key board structure 200 includes a key-cap 210, a base 220, and a linking-up mechanism 230. Wherein the key-cap 210 is disposed on the base 220, and the linking-up mechanism 230 is connected between the base 220 and the key-cap 210. The linking-up mechanism 230 includes a first frame 232 and a second frame 234. The first frame 232 is pivoted to the base 220. The first frame 232 has two openings 232*a* and two guide slots 232*b* on the two opposite sides thereof, and the openings 232*a* are connected correspondingly to the guide slots 232*b*. The second frame 234 is connected to the key-cap 210. The first frame 232 and the second frame 234 are pivoted crosswise. In addition, the second frame 234 has two pivotal arms 234*a* and two open slots 234*b* on the two opposite sides thereof, wherein each of the second pivotal arms 234*a* has a fixing protrusion 235 pivoted in the opening 232*a*.

Referring to FIG. 2 again, in the keyboard structure 200, the fixing protrusions 235 are protruded from the external sides of the second pivotal arms 234*a*, and the open slots 234*b* are located in the second pivotal arms 234*a* and extended along the length of the second pivotal arms 234*a*. Wherein the area of the second pivotal arms 234*a* between the fixing protrusions 235 and the open slots 234*b* is an elastic deformation portion. In addition, the first frame 232 may have two first pivotal arms 232*e*, two openings 232*a* penetrating through the first pivotal arms 232*e*, and two guide slots 232*b* located at the internal sides of the first pivotal arms 232*e* and connecting the near ends of the openings 232*a*.

Figure 4:
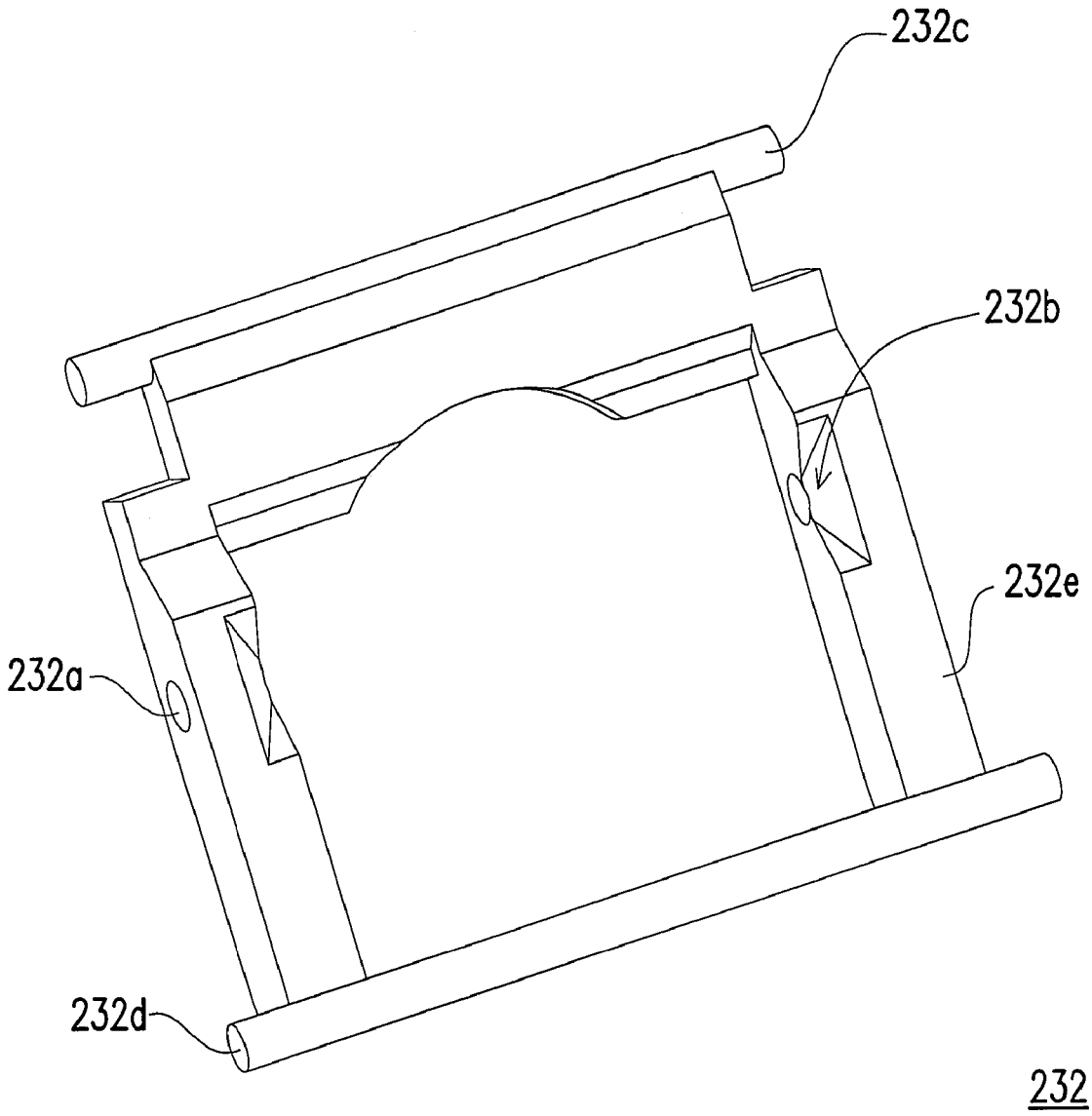
FIG. 4 is a diagram illustrating assembling a second frame to a key-cap according to an embodiment of the present invention.
Figure 5:
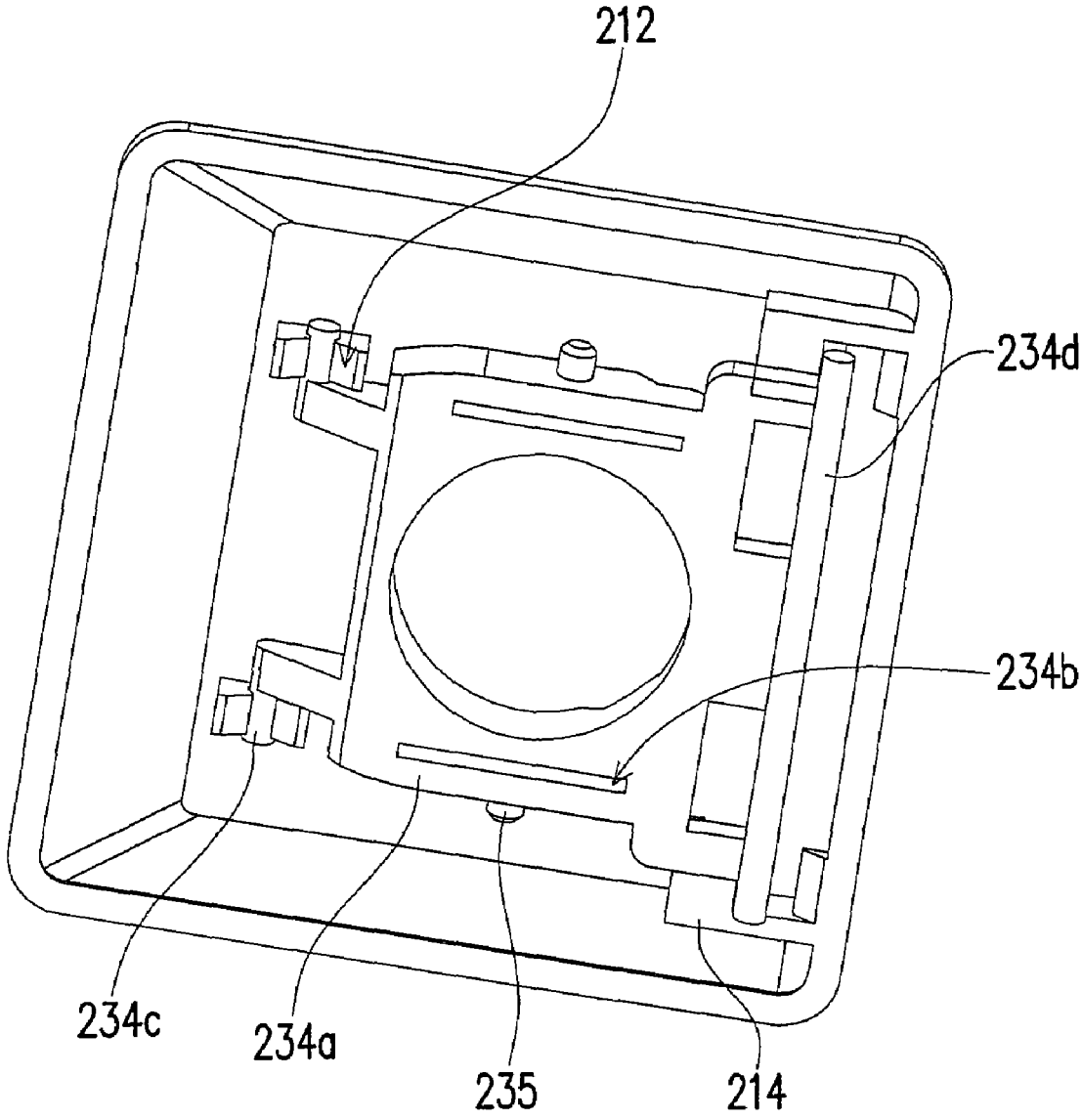
FIG. 5 is a diagram illustrating the cross pivoting between a first frame and a second frame according to an embodiment of the present invention.

FIG. 4 is a diagram of the first frame in FIG. 2, and FIG. 5 is a diagram illustrating assembling the second frame to the key-cap in FIG. 2. Referring to both FIGS. 2, 4, and 5, to be specific, the key-cap 210 may have two first slots 212 and two first fixing bumps 214 (as shown in FIG. 5). The second frame 234 has a first pivotal rod 234*c* suitable for being locked in the first slots 212. The first frame 232 has a first sliding rod 234*c*, and the movement of the first sliding rod 234*c* is restricted by the first fixing bumps 214. The base 220 may have two second slots 222 and two second fixing bumps 224. The first frame 232 has a first pivotal rod 232*d* which is locked in the second slots 222 correspondingly. The second frame 234 has a second sliding rod 234*d*, and the movement of the second sliding rod 234*d* is suitable for being restricted by the second fixing bumps 224.

Next, the assembly of the keyboard structure 200 will be described hereinafter. Referring to FIG. 2 and FIG. 3, the assembly procedure of the keyboard structure 200 includes following steps. First, the first frame 232 and the second frame 234 are provided. Then, the fixing protrusions 235 of the second frame 234 are moved along the guide slots 232*b* correspondingly and placed into the openings 232*a*, so that the first frame 232 is pivoted to the second frame 234 crosswise to form the linking-up mechanism 230. It should be noted that to pivot the fixing protrusions 235 of the second frame 234 into the openings 232*a* of the first frame 232 smoothly, the guide slots 232*b* may be V-shape slots which can guide the movement of the fixing protrusions 235 (as shown in FIG. 4).

Moreover, in the present embodiment, an automatic assembly method may be used for pivoting the first frame 232 to the second frame 234 crosswise so as to form the linking-up mechanism 230. In other words, the assembly method of the linking-up mechanism 230 may be placing and fixing the first frame 232 on a conveyer belt (not shown), and then holding the second frame 234 with a mechanical arm (not shown) and moving the fixing protrusions 235 of the second frame 234 along the corresponding guide slots 232*b* and placed into the openings 232*a*.

It should be noted that when the fixing protrusions 235 of the second frame 234 are moved along the corresponding guide slots 232*b* and placed into the openings 232*a*, the elastic deformation portion of the second frame 234 is suitable for being pressed so as to deform the open slots 234*b*. The deformation of the open slots 234*b* allows the second frame 234 to cushion a pressing force, so as to prevent the first frame 232 and the second frame 234 from being damaged. Next, the second frame 234 is passed between the two first pivotal arms 232*e* of the first frame 232, and the fixing protrusions 235 of the second frame 234 are pivoted in the openings 232*a* of the first frame 232, so that the first frame 232 and the second frame 234 are pivoted crosswise to form the linking-up mechanism 230.

After that, the base 220 and the key-cap 210 are provided and the linking-up mechanism 230 is connected between the base 220 and the key-cap 210. In the present embodiment, the linking-up mechanism 230 is manually connected between the base 220 and the key-cap 210. In other words, an assembly worker locks the second pivotal rod 234*d* of the second frame 234 into the second slot 222 of the base 220, so that the second frame 234 is pivoted to the base 220. After that, the assembly worker buckles the key-cap 210 on the first frame 232. To be specific, the first sliding rod 234*c* of the second frame 234 is locked in the first slots 212 of the key-cap 210, and the first pivotal rod 232*c* of the first frame 232 is locked in the first fixing bumps 214 of the key-cap 210. Moreover, the second fixing bumps 224 of the base 220 are used for restricting the movement of the second pivotal rod 234*d* of the second frame 234, so that all the keys on the keyboard have the same height when a user is using the keyboard.

In summary, the keyboard structure and the assembly method thereof in the present invention have at least following advantages:

1. The first frame has guide slots for guiding the fixing protrusions of the second frame to be fixed into the openings, thus, the first frame and the second frame can be pivoted crosswise to form a linking-up mechanism by an automatic assembly method.
2. The second frame has an elastic deformation portion and open slots for cushioning a pressing force, thus, the first frame and the second frame can be prevented from being damaged when the keyboard structure is assembled automatically, and accordingly the assembly qualified rate can be increased.

3. With the automatic assembly method, the labor cost can be reduced and the production yield can be increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A keyboard structure, comprising:

a base;

a key-cap, disposed on the base;

a linking-up mechanism, connected between the base and the key-cap, the linking-up mechanism comprising:

a first frame, pivoted to the base, wherein the first frame has two openings and two guide slots on two opposite sides, and the two openings are connected to the two guide slots correspondingly; and a second frame, connected to the key-cap, the first frame and the second frame being pivoted crosswise, wherein the second frame has two second pivotal arms and two open slots on two opposite sides, each of the pivotal arms has a fixing protrusion, the fixing protrusions are respectively pivoted in the openings, the fixing protrusions are protruded from the external sides of the second pivotal arms, and the open slots are located in the second pivotal arms and extended along a length of the pivotal arms, and an area of the second pivotal arms between the fixing protrusions and the open slots is an elastic deformation portion.

2. The keyboard structure as claimed in claim 1, wherein the key-cap has two first slots and two first fixing bumps, the second frame has a second pivotal rod corresponding to the first slots, and the first frame has a first sliding rod corresponding to the first fixing bumps.

3. The keyboard structure as claimed in claim 1, wherein the base has two second slots and two second fixing bumps, the first frame has a first pivotal rod corresponding to the second slots, and the second frame has a second sliding rod corresponding to the second fixing bumps.

4. The keyboard structure as claimed in claim 1, wherein the first frame has two first pivotal arms, the openings pass through the first pivotal arms, and the guide slots are disposed at the internal sides of the first pivotal arms and connect the ends of the openings.

5. The keyboard structure as claimed in claim 4, wherein the guide slots are V-shaped slots.

6. A keyboard assembly method, comprising:

providing a first frame and a second frame, wherein the first frame has two openings and two guide slots on the two opposite sides, the two openings are connected to the two guide slots correspondingly, the second frame has two second pivotal arms and two open slots on two opposite sides, wherein fixing protrusions are protruded from the external sides of the second pivotal arms, and the open slots are located in the second pivotal arms and extended along a length of the pivotal arms, and an area of the second pivotal arms between the fixing protrusions and the open slots is an elastic deformation portion;

moving the fixing protrusions of the second frame along the corresponding guide slots and placing the fixing protrusions into the openings so that the first frame being pivoted crosswise to the second frame to form a linking-up mechanism; and providing a base and a key-cap, and connecting the linking-up mechanism between the base and die key-cap.

7. The keyboard assembly method as claimed in claim 6, wherein the step for moving the fixing protrusions along the corresponding guide slots and placing the fixing protrusions into the openings comprises using a mechanical arm.

8. The keyboard assembly method as claimed in claim 6, wherein the step for connecting the linking-up mechanism between the base and the key-cap comprises:

connecting the first frame to the key-cap; and pivoting the second frame to the base.

* * * * *